US005083382A

United States Patent [19]

Brashears

[11] Patent Number: 5,083,382

[45] Date of Patent: Jan. 28, 1992

[54] ADJUSTABLE FLIGHTS WITH DAMS FOR ROTARY DRYERS

[75] Inventor: David F. Brashears, Belle Isle, Fla.

[73] Assignee: Gencor Industries Inc., Orlando, Fla.

[21] Appl. No.: 627,244

[22] Filed: Dec. 11, 1990

[51] Int. Cl.[5] ..... F26B 13/00

[52] U.S. Cl. ..... 34/135; 34/136; 432/118; 110/246; 110/226

[58] Field of Search ..... 34/135, 136, 137, 139; 432/118; 110/246, 226

[56] References Cited

U.S. PATENT DOCUMENTS

| | | | |
|---|---|---|---|
| 1,817,833 | 8/1931 | O'Connell et al. . | |
| 2,469,882 | 5/1949 | Locke | 34/136 |
| 2,815,940 | 12/1957 | Madsen | 259/3 |
| 3,025,611 | 3/1962 | Preeman | 34/137 |
| 3,098,797 | 7/1963 | Graff et al. | 34/135 |
| 3,219,329 | 11/1965 | Goins | 263/33 |
| 3,641,683 | 2/1972 | Preeman | 34/132 |
| 3,814,588 | 6/1974 | Eweson et al. | 23/259 |
| 3,910,756 | 10/1975 | Henning | 432/118 |
| 4,181,495 | 1/1980 | Bernt | 432/118 |
| 4,193,208 | 3/1980 | Ronning | 34/136 |
| 4,293,228 | 10/1981 | Swisher, Jr. et al. | 366/25 |
| 4,307,520 | 12/1981 | Lutz | 34/108 |
| 4,338,732 | 7/1982 | Coxhill | 34/135 |
| 4,391,206 | 7/1983 | Matteini | 432/118 |
| 4,742,622 | 5/1988 | Thompson | 34/135 |

*Primary Examiner*—Henry A. Bennett
*Assistant Examiner*—Denise L. F. Gromada
*Attorney, Agent, or Firm*—Nixon & Vanderhye

[57] ABSTRACT

The rotary drum dryer includes a plurality of circumferentially spaced flights in each of a plurality of axially spaced flight sections. A radially inwardly directed dam is interposed between each flight section and serves as a pivotal mount for the flights of each section. The dams are provided with arcuate slots having a plurality of detent positions arranged about mounting holes for pins secured to the flights and forming the pivot axis therefor. The angular position of the flights is adjustable by locating bolts on the flights in selected detented positions in the arcuate tracks. The combination of pivotally mounted flights and dams affords more uniform veiling across the drum interior and provides efficient heat transfer to the aggregate from the hot gases of combustion.

18 Claims, 3 Drawing Sheets

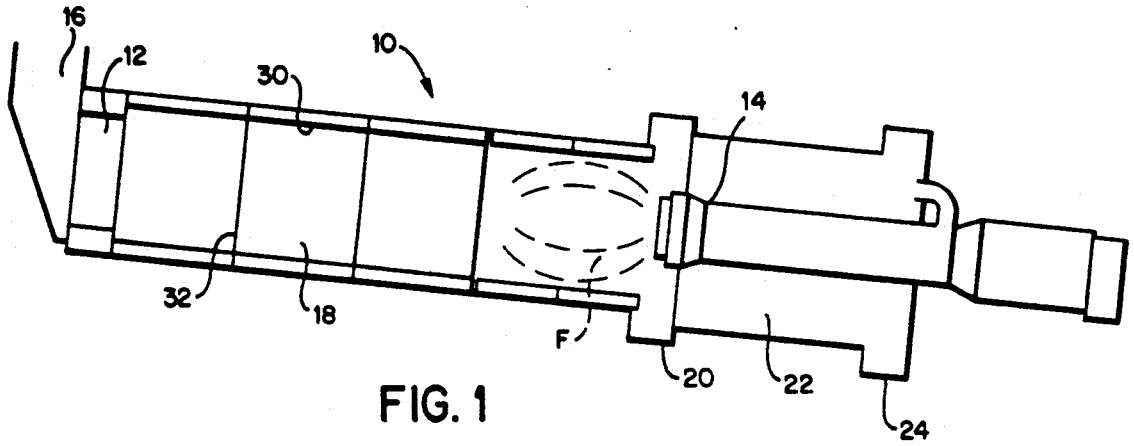
FIG. 1
FIG. 2 *PRIOR ART*
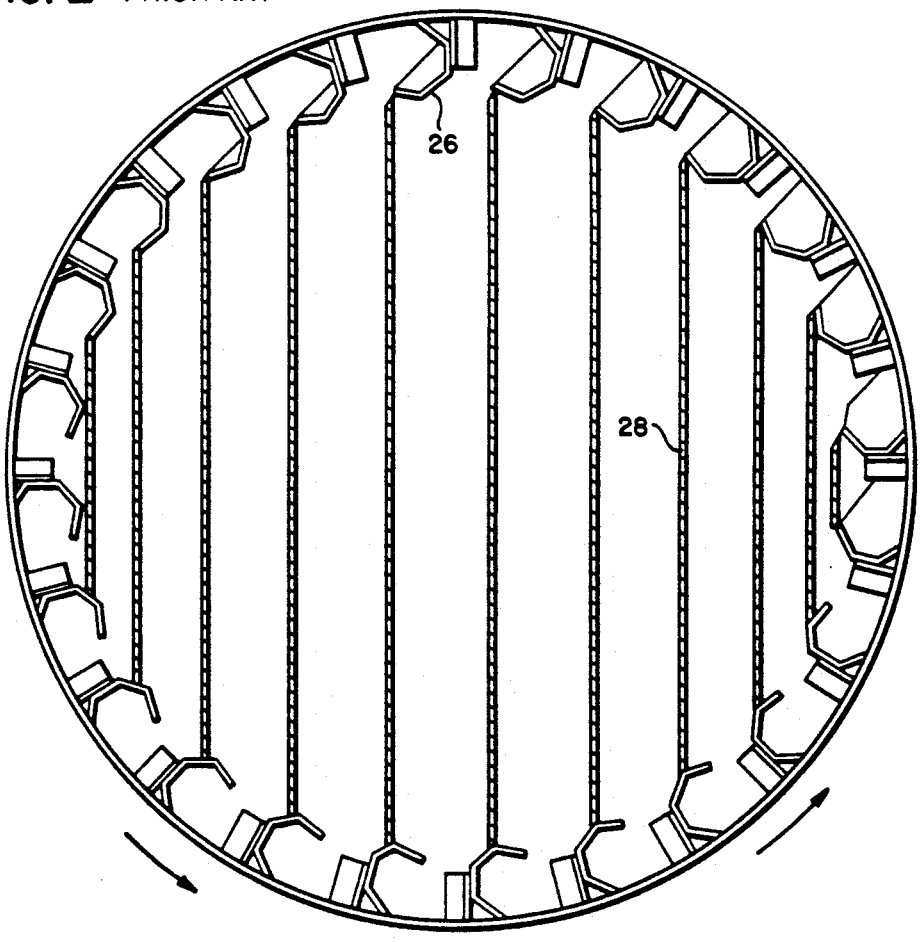

FIG. 5A
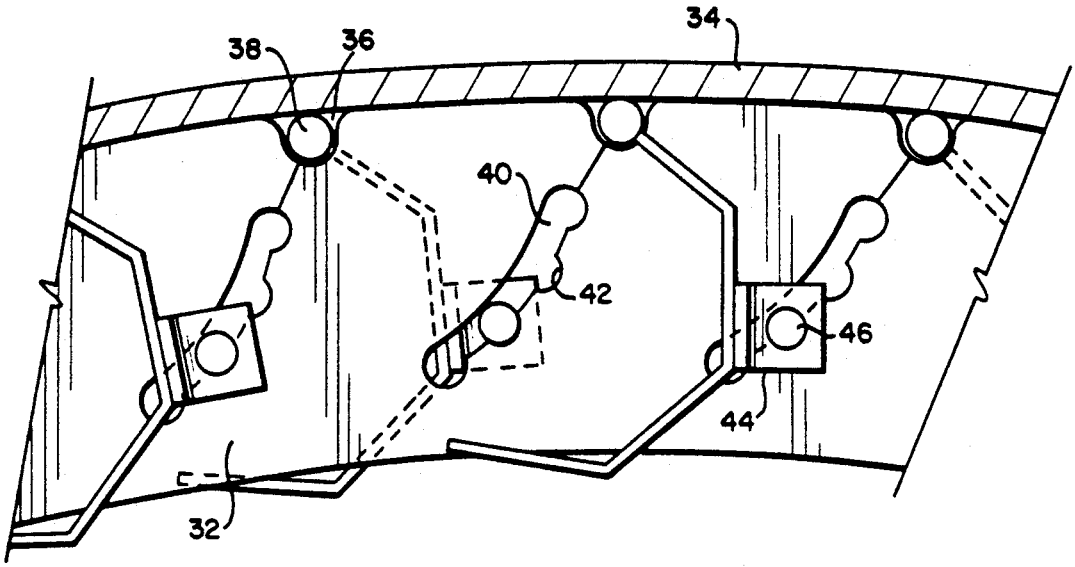
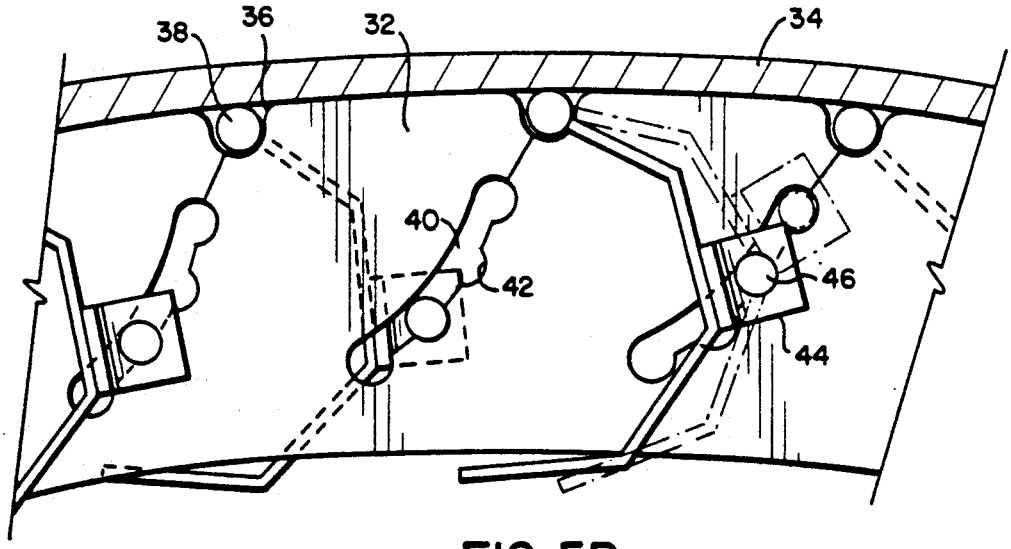
FIG. 5B

ADJUSTABLE FLIGHTS WITH DAMS FOR ROTARY DRYERS

BACKGROUND AND SUMMARY OF THE INVENTION

The present invention relates to rotary drums for drying particulate matter and particularly relates to rotary drum dryers having flights for creating a veiling effect across the interior of the drum and dams in the drum for preventing hot gases of combustion from bypassing, and directing such gases into, the veiling particulate matter.

Rotary drum dryers are used in many applications for drying particulate matter. For example, in the asphalt industry, it is common practice to flow aggregate through a rotatable drum having a burner for flowing hot gases of combustion in heat exchange relation with the aggregate to dry the latter. Flights are typically provided along the interior surface of the drum and provide a veiling effect across the drum cross-section. The aggregate veil efficiently absorbs the heat from the hot gases of combustion flowing axially through the drum. Because of the differences in flow and drying characteristics of various aggregates, there is no optimum flight design that can be utilized in all rotary drum dryers. Variations in aggregate gradation for different pavement design mix, as well as the use of recycled asphalt, which does not flow through the veiling portion of the drum, renders the tuning of the flights important to obtain optimum operation. Also, fixed flights produce wide variations in the temperature of the gases exhausted from the drum, rendering operation inefficient and costly.

Adjustable flights have previously been used in rotary dryers and have enabled plant owners to adjust their flighting for optimum veiling conditions with various types of aggregates, recycle rates and production rates. Even with adjustable flights, however, problems occur in attempting to produce a veil through the drying section of the drum which will provide substantially uniform veiling across the drum for optimum heat transfer. One problem in efforts to provide uniform veiling is that the flighting, typically on the downhill side of the drum during drum rotation, cascades less than one-half of the material which cascades from the flighting on the uphill side of the drum. In other words, the flighting on the downhill side of the rotary drum produces less dense veiling than the density of the veiling produced by the flighting on the uphill side of the drum. As a result of this variation in veiling density across the drum, gases from the combustion burner frequently follow the course of least resistance through the drum, i.e., through the veiling having the lesser density adjacent the downhill side of the drum, and therefore bypass the veiling aggregate along the other side of the drum. This also undesirably increases the drum skin temperature on the downhill side of the drum.

Dams have previously been provided within rotary drum dryers to deflect gases passing along the wall surfaces for flow back toward the centerline of the drum to achieve more effective heat transfer with the aggregate. These dams are also helpful in retarding the flow of material through the drum at low production rates and provide a more consistent flight loading at low production rates.

According to the present invention, there is provided a combination of dams and adjustable flights where the dams and adjustable flights cooperate to enable the dam to support the flights and permit their adjustment into selected angular positions. Particularly, the flights are mounted adjacent the interior wall surface of the drum at circumferentially spaced positions thereabout by pivotal mountings which cooperate with a dam at each end of the flight. Each dam includes an annular plate extending along the interior surface of the drum, with apertures along the outer periphery of the plate opening into the interior surface of the drum. The end of each flight has a pin received in an aperture for pivotally securing the flight adjacent the interior wall surface of the drum. The dams and flights have attachments cooperable to pivot the flights into selected adjusted angular positions dependent upon the type of aggregates used and other production parameters. To accomplish this, there is provided, for each flight, an arcuate track or slot in each dam at the opposite ends of the flight. Each slot has a plurality of stops or detent positions. Each flight carries a bracket at its opposite ends and a removable pin projects from each bracket for securement in a selected detented position along the slot. In this manner, the angle of each flight relative to a tangent to the drum at the location of the flight can be adjusted by pivoting the flight and engaging and securing the pins in the selected detent positions along the slots.

By employing this construction, flights may be adjusted angularly depending on the type of aggregate to more closely obtain a uniform veiling effect. The dams prevent the gases from bypassing the veiling aggregate by flow down a side of the drum and forces the gases toward the center of the drum into and through the veiling aggregate. The dams also provide a portion of the support for the angular adjustment mechanism of the flights, the angle of the flights determining the holding capacity thereof and the veiling characteristics.

More particularly, the dam is preferably welded to the interior surface of the drum. Thus, the drum surface, in cooperation with the apertures in the dam, supports the flights. Additionally, it will be appreciated that sections of flights are provided the drum at axially spaced positions therealong, with dams intervening between the flight sections. By providing twice as many detent positions and arcuate slots or tracks in each dam as flights in each axial section of the drum, i.e., on each side of the dam, the rows of flights can be circumferentially staggered relative to one another. This increases the uniformity of the density of the veiling through the drum and enhancing the heat transfer from the combustion gases to the aggregate.

In a preferred embodiment according to the present invention, there is provided a rotary dryer comprising a generally elongated cylindrical drum, and a plurality of flights spaced one from the other about the interior surface of the cylindrical drum with each flight extending therefrom at a predetermined angle relative to a tangent to the drum at the location of the flight. A dam extends about the interior surface of the drum and is located adjacent like ends of the flights at a predetermined axial location along the drum and means cooperable between the flights and the dam are provided for mounting the flights at selected angular positions relative to the tangents to the drum, respectively.

In a further preferred embodiment according to the present invention, there is provided a rotary dryer comprising a generally elongated cylindrical drum, and a pair of sections of flights spaced axially one from the other along the drum, each of the sections having a plurality of flights spaced circumferentially one from the other about the interior surface of the cylindrical drum with each flight extending therefrom at a predetermined angle relative to a tangent to the drum at the location of the flight. A dam extends about the interior surface of the drum and is located between the sections of flights at a predetermined axial location along the drum. Means cooperable between the flights in each section thereof and the dam are provided for mounting the flights at selected angular positions relative to the tangents to the drum.

In a further preferred embodiment according to the present invention, there is provided a rotary dryer for drying aggregate comprising a generally elongated drum having an axis, a plurality of flights spaced one from the other circumferentially about the interior surface of the drum for containing aggregate, a dam extending circumferentially about the interior surface of the drum and means cooperable between the flights and the dam for varying the aggregate holding capacity and veiling characteristics of the flights.

Accordingly, it is a primary object of the present invention to provide a novel and improved rotary drum dryer having adjustable flights and dams cooperable with one another to vary the holding capacity and veiling characteristics of the flights depending on the type of aggregates and other production parameters and thereby, among other things, provide for more efficient heat transfer and eliminate or minimize any tendency of the hot gases of combustion to bypass the aggregate veil.

These and further objects and advantages of the present invention will become more apparent upon reference to the following specification, appended claims and drawings.

BRIEF DESCRIPTION OF THE DRAWING FIGURES

FIG. 1 is a schematic longitudinal cross-sectional view through a rotary drum dryer illustrating the flights and dams according to the present invention in the dryer;

FIG. 2 is an enlarged cross-sectional view taken along a plane normal to the axis of a conventional drying drum and illustrating conventional flighting within the drum;

FIGS. 5A and 5B are fragmentary enlarged axial views of a section of flights illustrating the different angular positions thereof.

DETAILED DESCRIPTION OF THE DRAWING FIGURES

Figure 3:
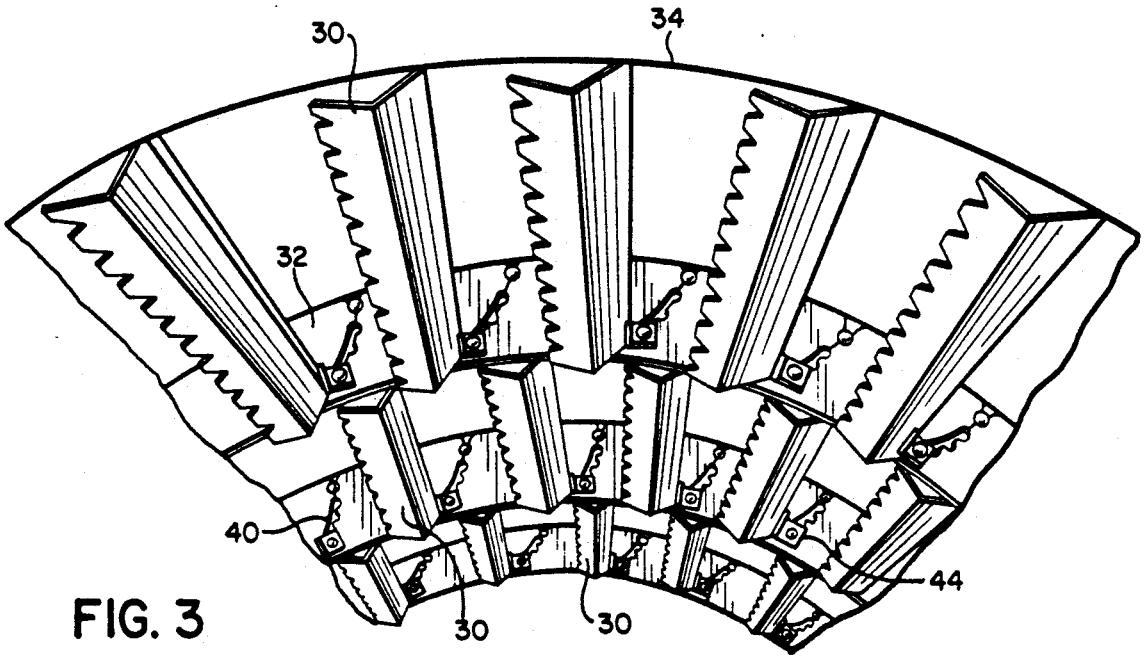
FIG. 3 is a fragmentary perspective view illustrating flighting and dams constructed in accordance with the present invention and arranged about the interior surface of a dryer drum.
Figure 4:
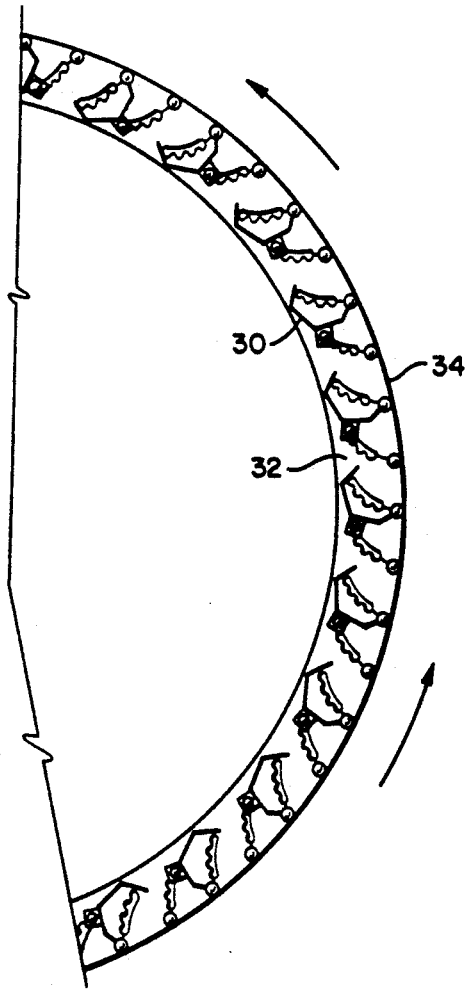
FIG. 4 is a fragmentary view similar to FIG. 2 illustrating the flights and dams of the present invention.

Reference will now be made in detail to a present preferred embodiment of the invention, an example of which is illustrated in the accompanying drawings.

Referring now to the drawings, particularly to FIG. 1, there is illustrated a rotary drum dryer having flights and dams constructed and arranged in accordance with the present invention, the rotary drum dryer being otherwise conventional in construction. Thus, the rotary drum dryer is generally designated 10 and, in this instance, is a counterflow dryer. The drum is normally mounted for rotation about an inclined axis such that particulate material, i.e., aggregate, may be disposed into drum 10 at an inlet end 12 for flow through the rotating drum toward a burner 14 adjacent the lower end of the drum. In this illustrated drum, the burner has an elongated burner tube for locating the burner flame F about ⅓ of the length of the drum from its lower end. Hot gases of combustion therefore pass from burner 14 in counterflow relation to the flow of aggregate toward the aggregate inlet end of the drum 12 for flow through an outlet 16. For drying aggregate, the aggregate passes through the drying section 18 of drum 10 and may be discharged from the drum through a discharge outlet 20. Where aggregates are dried and combined with asphaltic recycle, the recycle is inlet into the drum behind the burner flame F for combining adjacent with the dried aggregate in an isolated zone 22 of drum 10. In the isolated zone, the dried aggregate, recycle and a fresh supply of asphalt are combined and the asphalt product is discharged through an outlet 24.

In conventional drum dryers, the drying zone 18 typically has a plurality of flights secured along the interior surface of the drum wall. The flights, for example, the flights 26 illustrated in FIG. 2, are designed to lift the aggregate from adjacent the bottom of the drum and carry the aggregate about the drum and, in response to its rotation, so that the aggregate can be spilled from the flights to create a veiling effect in the drum. Thus, as illustrated in FIG. 2, the aggregate, designated 28, is discharged from each flight on the uphill side of the drum as the drum rotates and the flights are shaped such that aggregate 28 is likewise discharged from flights on the downhill side of the drum. It will be appreciated, however, and as illustrated in FIG. 2, that, in most constructions of this type, the quantity of aggregate material discharged from the flights on the uphill side greatly exceeds the quantity of aggregate material discharged from the flights on the downhill side. Hence, the veiling aggregate is more dense on the uphill side than on the downhill side of the drum. As a result of this, hot gases of combustion tend to flow along areas or toward volumes of least resistance and, consequently, the hot gases tend to flow along the downhill side of the drum. This, as previously explained, causes non-uniform heating of the aggregate, locates the heat transfer medium, i.e., the hot gases of combustion, displaced from the majority of the aggregate to be heated and dried, and overheats the downhill side of the drum.

Referring to FIG. 3, there is illustrated in a fragmentary perspective view three of the axially spaced sections of flighting, with intervening dams, all constructed in accordance with the present invention. The flighting 30 of the present invention includes elongated, generally trough-like flights circumferentially spaced from each other and extending parallel to the axis of the drum in each of the plurality of axially spaced sections thereof. It will be appreciated that the configuration of the flights per se may vary from that shown and that the flights per se may be used with other types of drums, including parallel and counterflow drums, as well as those with different burner locations.

Interposed between each axial section of flights 30 is a dam 32. Each axially spaced dam 32 comprises an annulus secured along its outer rim to the interior wall 34 of the drum 10, e.g., by welding. Thus, the dam 32 extends radially inwardly from the interior wall 34 of drum 10 and diverts or directs the hot gases of combustion flowing along the wall surfaces radially inwardly toward central portions of the drum. As indicated previously, the dams provide a pivotal mounting for the flights 30.

Particularly, each dam is provided with a series of circumferentially spaced openings 36 formed along its outer rim to define with the wall 34 of drum 10 a plurality of circumferentially spaced apertures 36 for receiving the ends of pivot pins or rods 38. The pivot rods or pins are secured to the radially outermost portions of the flights 30 and enable the flights 30 to be pivoted into selectively adjustable angular positions, in a manner to be described.

Each dam 32, as best illustrated in FIGS. 5A and 5B, includes a slot 40 formed along the arc of a circle having at its center an aperture 36. Each slot contains a plurality of detent positions or stops 42, in this case, a plurality of recesses 42 formed along the outermost arcuate edge of slot 40 at circumferentially spaced positions therealong. On the back side of each flight 30 there is provided a bracket 44 which carries a pin 46. Pin 46 may comprise a bolt with a removable nut or keeper element on its opposite side. The bracket 44 and pin 46 mounted on bracket 44 are located such that the pin 46 lies along the arcuate slot 40. Consequently, by rotating the flight 30 to align bracket 44 with one of the selected recesses 42 along slot 40, the flight may be secured in angularly adjusted position relative to the wall of the drum by inserting the pin 46 into the bracket 44 and detent 42 and securing the pin in that position.

It will be appreciated that the flights are not pivotable during actual drying operations but are pre-set before drying into the selected angular position depending upon the production rates and type of aggregates being dried. To adjust each flight, the keeper element or nut on the pin 46 is unthreaded or removed whereby the pin can be removed from the recess 42 and the flight angularly adjusted into the desired position. The pin can then be reinserted through the appropriate bracket 44 and recess 42 to retain the flight in the angularly adjusted position.

From a review of FIGS. 3, 5A and 5B, it will be appreciated that the flights 30 are disposed in axially spaced sections and that the flights of each section may be staggered circumferentially relative to the flights of the other sections. Thus, the flights 30 in one section may be pivotally mounted to every other aperture 36 and use every other arcuate slot 40 as a means for retaining those flights in angularly adjusted positions. The flights in the next axial section of the drum has pivots 38 disposed in the remaining alternate apertures 36 with its retaining pins 46 engaged in the alternate arcuate slot 40 of the common dam 32. Not only does this facilitate mounting of the flights to the dams, but also enables a more uniform veiling action through the staggering of the flights. That is, the discharge of aggregate from the staggered flights will substantially fill the entire cross-section of the interior of drum 10, with the dams directing the hot gases of combustion substantially radially inwardly for efficient heat transfer from the hot gases of combustion to the aggregate veiling across the drum.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A rotary dryer comprising:

a generally elongated cylindrical drum;

a plurality of flights spaced one from the other about the interior surface of said cylindrical drum with each flight extending inwardly therefrom at a predetermined angle relative to a tangent to the drum at the location of the flight;

a radially inwardly directed, circumferentially continuous dam extending about the interior surface of said drum and located adjacent like ends of said flights at a predetermined axial location along said drum; and means cooperable between said flights and said dam for mounting said flights at selected angular positions relative to said tangents to said drum, respectively.

2. A dryer according to claim 1 including means cooperable between said dam and said flights for pivotally mounting said flights for movement between said selected angular positions.

3. A dryer according o claim 2 wherein said pivotal mounting means includes a pivot pin carried by one of said flights and said dam and an aperture formed in the other of said flights and said dam for receiving said pin.

4. A dryer according to claim 3 wherein said aperture lies in said dam and opens into the interior of said wall.

5. A dryer according to claim 1 wherein said mounting means includes a plurality of stops carried by said dam and stop engaging means carried by said flights for engaging said stops at different angular positions of said flights.

6. A dryer according to claim 5 including means for pivotally mounting said flights relative to said dam adjacent the interior wall surface of said drum.

7. A dryer according to claim 1 wherein said mounting means includes a slot in said dam adjacent each flight and a plurality of detent positions along said slot, means carried by each said flight for engaging in a selected one of said detent positions in said slot for locating the flight in a selected angular position relative to said tangent.

8. A dryer according to claim 7 including means for pivotally mounting each said flight relative to said drum adjacent the interior wall surface of said drum and radially outwardly of said engaging means.

9. A dryer according to claim 1 including a second radially inwardly directed, circumferentially continuous dam extending about the interior surface of said drum and located adjacent the opposite like ends of said flights, and means cooperable between said flights and said second dam for mounting said flights at selected angular positions relative to said tangents to the drum.

10. A rotary dryer comprising:

a generally elongated cylindrical drum;

a pair of sections of flights spaced axially one from the other along said drum;

each of said sections having a plurality of flights spaced circumferentially one from the other about the interior surface of said cylindrical drum with each flight extending inwardly therefrom at a predetermined angle relative to a tangent to the drum at the location of the flight;

a radially inwardly directed, circumferentially continuous dam extending about the interior surface of said drum and located between said sections of flights at a predetermined axial location along said drum; and means cooperable between said flights in each section thereof said dam for mounting said flights at selected angular positions relative to said tangents to said drum.

11. A dryer according to claim 10 including means cooperable between said dam and said flights for pivotally mounting said flights for movement between said selected angular positions.

12. A dryer according to claim 11 wherein said pivotal mounting means includes a pivot pin carried by the flights of each section thereof and a plurality of apertures formed in said dam for receiving said pins.

13. A dryer according to claim 10 wherein said pivotal mounting means includes a slot in said dam adjacent each flight and a plurality of detent positions along said slot, means carried by each said flight for engaging in a selected one of said detent positions in said slot for locating the flight in a selected angular position relative to said tangent.

14. A dryer according to claim 13 including means for pivotally mounting each said flight relative to said drum adjacent the interior wall surface of said drum and radially outwardly of said engaging means.

15. A dryer according to claim 10 including second and third radially inwardly directed, circumferentially continuous dams extending about the interior surface of said drum and located adjacent the opposite ends of the flights of each section, and means cooperable between said flights of each section and said second and third dams, respectively, for mounting said flights at selected angular positions relative to said tangents to the drum.

16. A dryer according to claim 11 wherein the flights in each section are axially misaligned relative to the flights in the other section, said cooperating means including a plurality of apertures spaced circumferentially one from the other about said dam and a pin carried by each flight for reception in a corresponding aperture, the number of apertures being at least twice the number of flights in each section.

17. A rotary dryer for drying aggregate comprising:

a generally elongated drum having an axis;

a plurality of flights spaced one from the other circumferentially about the interior surface of said drum for containing aggregate;

a radially inwardly directed dam extending continuously and circumferentially about the interior surface of said drum; and means cooperable between said flights and said dam for varying the aggregate holding capacity and veiling characteristics of the flights.

18. A dryer according to claim 17 wherein said varying means includes means cooperable between said dam and said flights for pivotally mounting said flights for movement between said selected angular positions.

* * * * *